US007779967B2

(12) United States Patent
Kocher et al.

(10) Patent No.: US 7,779,967 B2
(45) Date of Patent: Aug. 24, 2010

(54) METHOD OF OPERATING AN ELEVATOR INSTALLATION, AN ELEVATOR INSTALLATION OPERABLE BY THIS METHOD AND SAFETY EQUIPMENT FOR THIS ELEVATOR INSTALLATION

(75) Inventors: Hans Kocher, Udligenswil (CH); Georges Gisler, Buchrain (CH)

(73) Assignee: Inventio AG, Hergiswil NW (CH)

( * ) Notice: Subject to any disclaimer, the term of this patent is extended or adjusted under 35 U.S.C. 154(b) by 542 days.

(21) Appl. No.: 11/851,590

(22) Filed: Sep. 7, 2007

(65) Prior Publication Data

US 2008/0067014 A1 Mar. 20, 2008

(30) Foreign Application Priority Data

Sep. 8, 2006 (EP) ..... 06120359

(51) Int. Cl.
*B66B 9/00* (2006.01)

(52) U.S. Cl. ..... 187/249; 187/394

(58) Field of Classification Search ..... 187/247, 187/249, 313, 391–394
See application file for complete search history.

(56) References Cited

U.S. PATENT DOCUMENTS

| | | | | |
|---|---|---|---|---|
| 2,708,715 | A * | 5/1955 | Meyers | 246/31 |
| 5,663,538 | A * | 9/1997 | Sakita | 187/382 |
| 5,877,462 | A * | 3/1999 | Chenais | 187/249 |
| 6,554,107 | B2 * | 4/2003 | Yumura et al. | 187/247 |
| 7,353,912 | B2 * | 4/2008 | Reuter et al. | 187/249 |
| 7,448,471 | B2 * | 11/2008 | Nuebling | 187/286 |
| 2008/0053757 | A1 * | 3/2008 | Kostka | 187/394 |

FOREIGN PATENT DOCUMENTS

| | | | |
|---|---|---|---|
| EP | 0 769 469 | A1 | 4/1993 |
| EP | 0 769 469 | B1 | 4/1993 |
| EP | 1 329 412 | A1 | 7/2003 |
| EP | 1 498 379 | A | 1/2005 |
| WO | WO 2004/043841 | A1 | 5/2004 |
| WO | WO 2004/043842 | A | 5/2004 |
| WO | WO 2006/097139 | A | 9/2006 |
| WO | WO 2007/050060 | A | 5/2007 |

* cited by examiner

*Primary Examiner*—Jonathan Salata
(74) *Attorney, Agent, or Firm*—Fraser Clemens Martin & Miller LLC; William J. Clemens

(57) ABSTRACT

An elevator installation with at least one upper elevator car and at least one lower elevator car includes a first electromechanical switching mechanism mounted on the upper car and having a weight fastened at a downwardly extending elongate run, the run being held in a travel setting by the weight force, and a second electromechanical switching mechanism mounted on the lower car vertically below the weight. In the case of undesired approach of the two elevator cars, the weight impinges on the second electromechanical switching mechanism and thereby opens a safety circuit of the lower elevator car. The safety circuit of the upper elevator car is also opened by a diminishing of the weight force.

8 Claims, 2 Drawing Sheets

METHOD OF OPERATING AN ELEVATOR INSTALLATION, AN ELEVATOR INSTALLATION OPERABLE BY THIS METHOD AND SAFETY EQUIPMENT FOR THIS ELEVATOR INSTALLATION

FIELD OF THE INVENTION

The invention relates to a method of operating an elevator installation, in particular for a multi-mobile elevator installation with several elevator cars in a shaft. Moreover, the invention relates to a corresponding elevator installation operable by this method and to safety equipment for this elevator installation in order to prevent collisions between these elevator cars.

BACKGROUND OF THE INVENTION

The elevator cars in such multi-mobile elevator installations are typically each equipped with an associated drive and an associated braking system. The electronic control of the entire elevator installation is frequently designed so that no collisions of the individual elevator cars should happen. Particularly in the case of an emergency stop or even in the case of a normal floor stop of a car, it cannot be ensured in all circumstances that a further elevator car disposed above or below in the same elevator shaft can still stop in good time in order to avoid a collision. This could be avoided by presetting, via the control, sufficient spacings between the individual elevator cars and also appropriately adapted vertical speeds. However, the conveying capacity of a multi-mobile elevator installation is not fully utilized due to such a preset, which has an influence on the cost/utilization efficiency.

A multi-mobile elevator installation is known from European Patent Specification EP 765 469 B1, which comprises means for opening the safety circuit of an elevator car if an undesired approach to another elevator car occurs. According to the stated patent specification there are present, at each elevator car, safety modules which evaluate the car positions and speeds so as to be able to trigger, in a given case, braking processes even at other elevator cars. The individual safety modules have to constantly know and evaluate the car positions and speeds of the other participating elevator cars in order to be able to correctly react to an emergency situation. A special decision module is needed for that purpose, which is responsible for determination of the stop commands in the emergency case.

A similarly complicated solution is known from International Patent Application WO 2004/043841 A1.

SUMMARY OF THE INVENTION

With consideration of the known arrangements it is an object of the present invention to provide a multi-mobile elevator installation where, on approach of elevator cars, the cars prior to collision are automatically stopped without a more complicated exchange of information between the elevator cars being necessary.

Stated in other words, this object is improvement of safe operation of multi-mobile elevator installations by simple and reliable means.

It is regarded as a further object of the present invention to so execute a "collision protection" that no additional shaft cross-section is used up or occupied.

The method according to the present invention for operating an elevator installation comprises at least one upper elevator car and at least one lower elevator car, which are both vertically movable substantially independently in a common elevator shaft of the elevator installation, and a first electromechanical switching mechanism arranged in a lower region of the upper elevator car, wherein the first electromechanical switching mechanism comprises a weight fastened to an elongate run, the first electromechanical switching mechanism being kept in a travel setting by the weight force of the weight fastened to the run. A second electromechanical switching mechanism is arranged in an upper region of the lower elevator car vertically below the weight fastened to the run, wherein the weight impinges on the second electromechanical switching mechanism in the event of undesired approach of the two elevator cars. A safety circuit of the lower elevator car is opened by means of the second electromechanical switching mechanism by the impinging of the weight. A safety circuit of the upper elevator car is opened by means of the first electromechanical switching mechanism by a diminishing of the weight force.

Advantageously the first electromechanical switching mechanism comprises a lever element, a force store and a switch, wherein the run is so fastened to the lever element that the lever element is kept in the travel setting by the weight force of the weight fastened to the run. The force store is so connected with the lever element that the lever element is transferred from the travel setting to an emergency setting when the weight force diminishes and the switch is then actuated and the safety circuit opened.

Advantageously the second electromechanical switching mechanism comprises a lever element, a force store and a switch, wherein the force store is so connected with the lever element that the lever element is kept in a travel setting. The second electromechanical switching mechanism is transferred from the travel setting to an emergency setting when the weight impinges on the lever element and the switch is then actuated and the safety circuit opened.

Advantageously the second electromechanical switching mechanism comprises a collecting element which is so designed that the weight impinges on the lever element of the second electromechanical switching element even when slight oscillations occur during approach of the elevator cars.

Moreover, an elevator installation is operable in accordance with the inventive method, which installation comprises a drive and a holding brake for each elevator car and wherein not only the drives of the two elevator cars are stopped, but also the holding brakes of the two elevator cars are triggered by the opening of the safety circuits.

Advantageously the first electromechanical switching mechanism and the second electromechanical switching mechanism form an electromechanical safety system in the elevator installation for precluding collision of the two elevator cars.

In addition, a safety equipment is a component of the elevator installation operable by the inventive method. This safety equipment comprises a first and a second electromechanical switching mechanism.

An advantage of the present invention lies in the simplicity and reliability of the solution. The switching mechanism can be advantageously produced with standard elements. In addition, on actuation of the switching mechanism the safety circuit of one car is opened independently of a communication between the elevator cars and the safety equipment. Thanks to the simple mode of construction and the autonomous functional capability the safety equipment is not susceptible to disturbances. Moreover, the described solution is simple to initialize when placing in operation, since only a few systems have to be matched to one another.

A further advantage of the present invention is apparent if the safety equipment is disposed in communication with a control unit of the elevator installation, because, when the weight impinges, the trigger mechanisms of the upper and lower elevator cars are actuated simultaneously. The control unit thus has available redundant information about an undesired approach of the elevator cars and can actuate appropriate reactions such as triggering of a safety brake or holding brake. This redundant design of the safety equipment increases the safety of the elevator installation.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
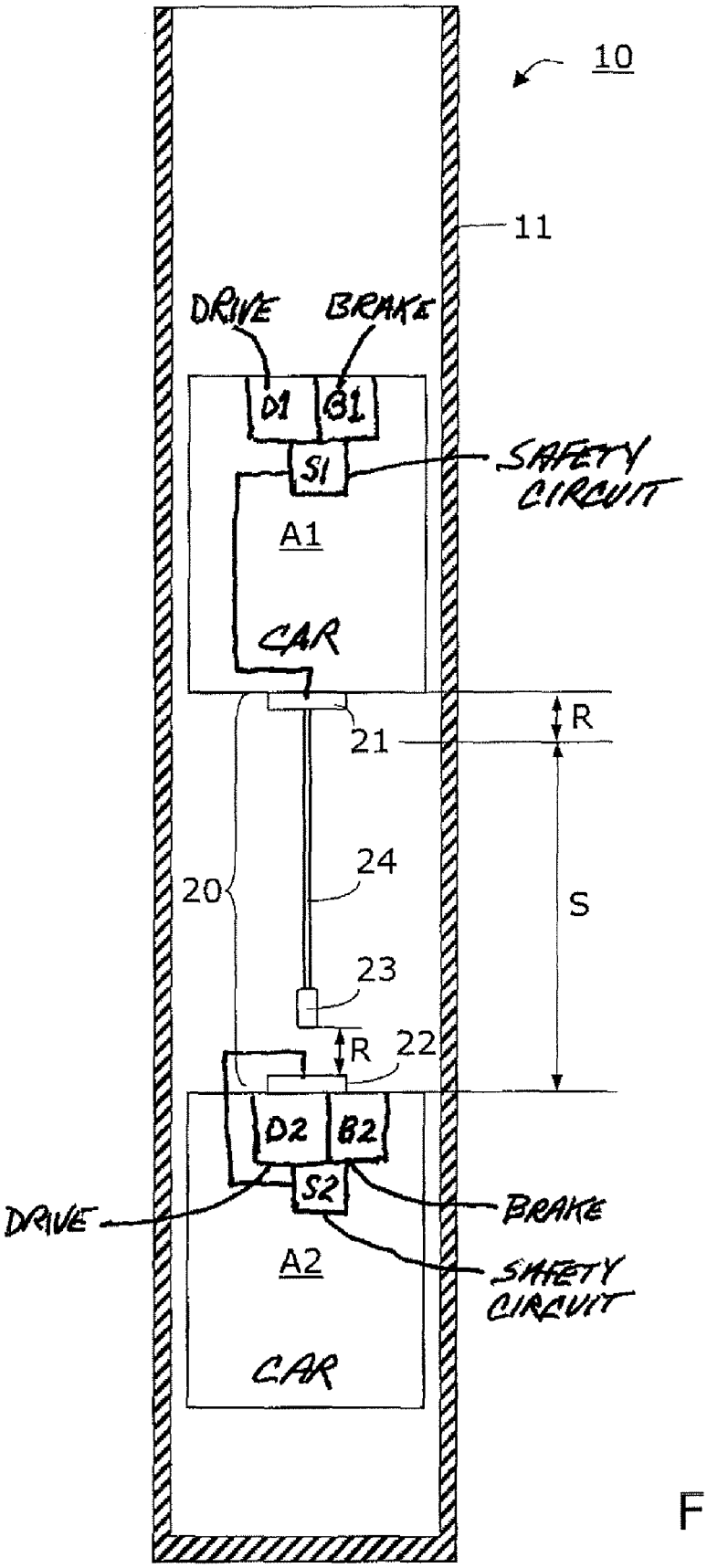
FIG. 1 is a schematic side elevation view of a first multi-mobile elevator installation according to the present invention.

A first embodiment of the present invention is described in connection with FIG. 1. A simple multi-mobile elevator installation 10 with an upper elevator car A1 and a lower elevator car A2 is shown, the two elevator cars being vertically movable substantially independently in an elevator shaft 11 of the elevator installation 10. For this purpose the elevator cars A1, A2 can be provided with individual drives D1, D2 or, for example, be individually couplable to a central drive system so as to enable individual movement in the elevator shaft 11. Numerous possibilities also exist for positioning of the drive. Thus, this can be positioned in stationary location in a separate engine space or directly in the elevator shaft 11 laterally of or above or below the elevator cars. Elevator concepts are also known in which the drives are a component of the elevator car A1, A2. A number of approaches are thus available for selection by the expert in order to be able to individually move the elevator cars of a multi-mobile elevator installation.

A safety equipment 20 comprising a first electromechanical switching mechanism 21 and a second electromechanical switching mechanism 22 is provided.

The first electromechanical switching mechanism 21 is, as schematically indicated, fastened in the lower region of the upper elevator car A1, for example in the floor region. The first electromechanical switching mechanism 21 comprises a weight 23 fastened to an elongate run 24, which keeps the first electromechanical switching mechanism 21 in a so-termed travel setting (normal setting) by the weight force G (FIG. 2) of the weight 23 fastened to the run 24.

The second electromechanical switching mechanism 22 is arranged and fastened in an upper region of the lower elevator car A2 vertically below the weight 23, which is fastened to the run 24, so that in the case of an undesired approach of the two elevator cars A1 and A2 the weight 23 impinges on the second electromechanical switching mechanism 22.

The two switching mechanisms 21 and 22 are so constructed and arranged that a safety circuit S2 of the lower elevator car A2 is automatically opened by means of the second electromechanical switching mechanism 22 by the impinging of the weight 23 and that a safety circuit S1 of the upper elevator car A1 opens by means of the first electromechanical switching mechanism 21 almost simultaneously by a diminishing of the weight force G and the reduction, which is connected therewith, of the tensile stress on the run 24.

The multi-mobile elevator installation 10 has, preferably for each elevator car A1, A2, an individual safety circuit S1, S2 in which several safety elements such as, for example, safety contacts and safety switches are arranged in series connection. The corresponding elevator car A1 or A2 can be moved only when the safety circuit and thus all safety contacts integrated therein are closed. The safety circuit S1, S2 is connected with the drive D1, D2 or a braking unit B1, B2 of the elevator installation 10 so as to interrupt the travel operation of the corresponding elevator car A1 or A2 if, for example, the safety circuit is opened by actuation of the electromechanical switching mechanism.

Switching-off of the two drives and triggering of the holding brakes of the two elevator cars A1 and A2 is preferably effected by the opening of the respective safety circuits.

The present invention can, however, also be used in elevator installations 10 which are equipped with a safety bus system instead with the mentioned safety circuit.

The described safety equipment 20 is a pure electromechanical system which does not require any exchange of information between the elevator cars or also any intervention (as far as incorporation in the safety circuits or safety bus systems of the participating elevator cars) in the elevator control, i.e. the safety equipment 20 operates completely autonomously and therefore functions even in such cases where disturbances occur in the control.

Figure 2:
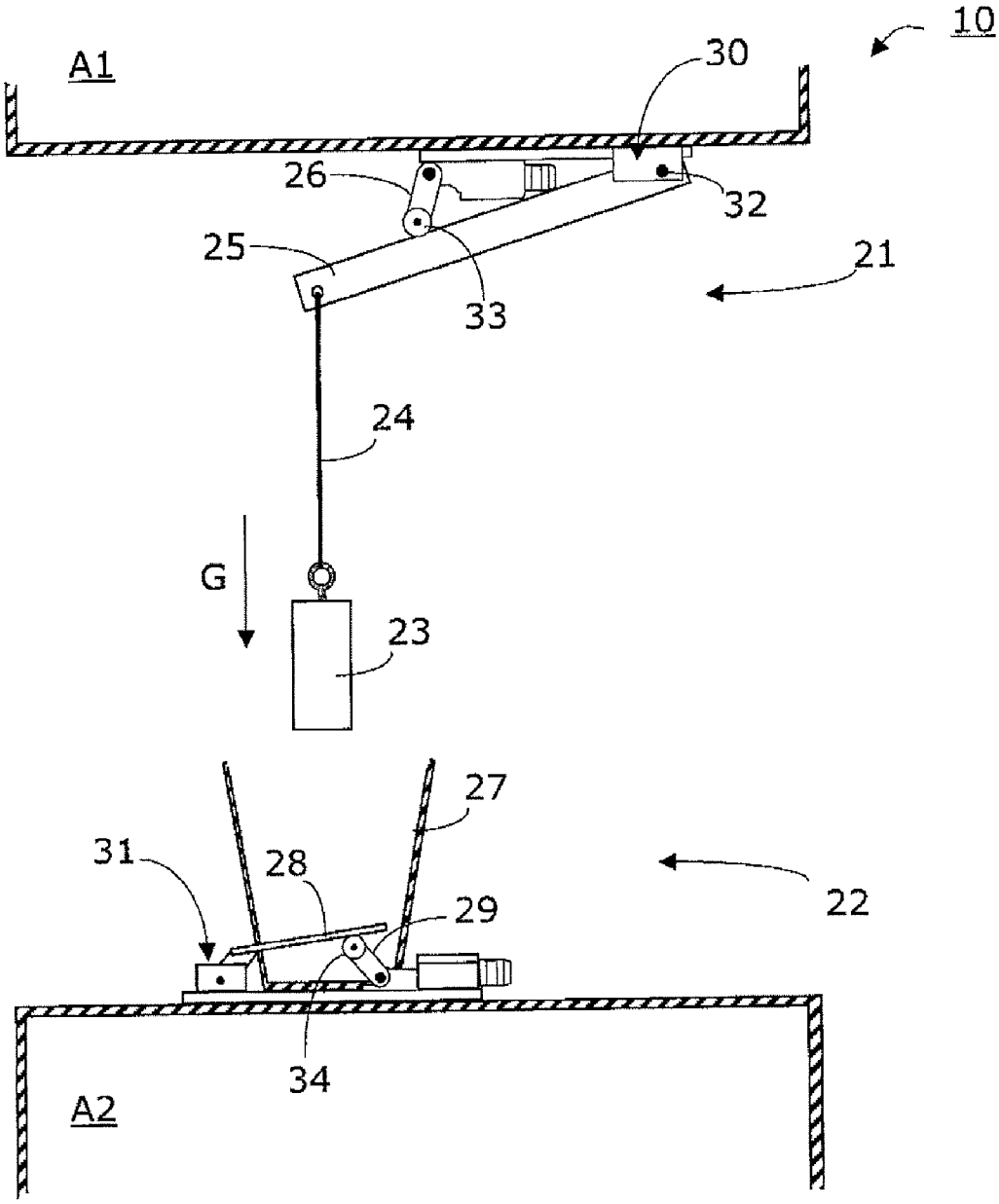
FIG. 2 is a schematic side elevation view of a part of a second multi-mobile elevator installation according to the present invention.

Details of a second embodiment are explained in connection with FIG. 2, wherein the same and similar components or components with the same function are provided in all figures with the same reference numerals. In the second embodiment as well, use is made of the two switching mechanisms 21 and 22 which are so constructed and arranged that the safety circuit of the lower elevator car A2 is automatically opened by means of the second electromechanical switching mechanism 22 by the impinging of the weight 23 and that the safety circuit of the upper elevator car A1 opens by means of the first electromechanical switching mechanism 21 almost simultaneously by a diminishing of the weight force G.

The first electromechanical switching mechanism 21 comprises an elongate lever element 25, a force store 30 and a switch 26. The run 24, for example a rope or cable, is so fastened to the lever element 25 that the lever element 25 is kept in the travel setting by the weight force G of the weight 23 fastened to the run 24. As the force store 30 use is made of an element which is so connected with the lever element 25 that the lever element is automatically transferred from the travel setting to an emergency setting when the weight force G diminishes and in that case the switch 26 is actuated. A spring-based mechanism is particularly suitable as the force store 30, which mechanism in the case of the arrangement shown in FIG. 2 is placed in the region of a pivot axis 32 of the lever element 25 and predetermines there a torque in order to move the lever element 25 about the pivot axis 32 in clockwise sense when the run 24 is relieved. However, a spring-based mechanism which pulls the lever 25 or presses this can also serve as the force store.

In every case the force store 30 must apply sufficient force in order to set the lever element 25 in motion and to trigger the switch 26 as soon as the strain on the run 24 significantly diminishes.

As the switch 26 use is preferably made of an element which is mechanically connected directly or indirectly with the element 25 and which is triggered as soon as the lever element 25 rotates about the pivot axis 32 to some extent in a clockwise sense. An embodiment of the switch 26 is shown in FIG. 2 which comprises a short lever with an end roller 33. On pivoting of the lever 25 the short lever moves and the switch 26 is actuated to open the safety circuit S1.

The second electromechanical switching element 22 also comprises a lever element 28, a force store 31 and a switch 29. The force store 31 is so connected with the lever element 28 that the lever element 28 is kept in a travel setting. When the weight 23 impinges on the lever element 28 of the second electromechanical switching mechanism 22 this is transferred from the travel setting to an emergency setting and in that case actuates the switch 29. The safety circuit S2 of the lower elevator car A2 is opened by the switch 26.

The second electromechanical switching mechanism 22 preferably comprises a collecting element 27 which is so designed that the weight 23 impinges on the lever element 28 of the second electromechanical switching mechanism 22 even in the case of slight oscillations during approach of the elevator cars A1, A2. In the illustrated example of embodiment a funnel serves as collecting element 27. This element 27 is, however, optional.

As the switch 29 use is preferably made of an element which is mechanically connected directly or indirectly with the lever element 28 and which is triggered as soon as the lever element 28 rotates about a pivot axis to some extent in counter-clockwise sense. In FIG. 2 an embodiment of the switch 29 is shown which comprises a short lever with an end roller 34. On pivoting of the lever element 28 the short lever moves and the switch 29 is actuated.

A simple, safe and robust electromechanical advance switching-off can be realized, in order to prevent collision of the elevator cars, by the means which were described in connection with the above-described first and second embodiments. Through the described safety equipment 20 an emergency stop is automatically triggered when a minimum spacing S is fallen below (see FIG. 1). The normal state is shown in FIG. 1 where both elevator cars A1 and A2 are disposed at a sufficient spacing S plus R from one another. If now the elevator cars A1 and A2 have further approached, wherein the spacing R reduces to zero, the weight 23 impinges on the second electromechanical switching mechanism 22 and triggers, by way of the switch 29, immediate stopping of the lower elevator car A2. At almost the same time the upper element 25 drives upwardly and immediate stopping of the upper elevator car A1 is also triggered by way of the switch 26.

If several elevator cars travel in the same shaft 11, then the corresponding safety equipment 20 can also be provided between these elevator cars.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of operating an elevator installation having at least one upper elevator car and at least one lower elevator car, which cars are both vertically movable substantially independently in a common elevator shaft of the elevator installation, comprising the steps of:

a. mounting a first electromechanical switching mechanism in a lower region of the at least one upper elevator car, wherein the first electromechanical switching mechanism includes a weight fastened to an elongate run, the weight applying a downwardly directed force to the run under the influence of gravity to maintain the electromechanical switching mechanism in a travel setting;

b. mounting a second electromechanical switching mechanism in an upper region of the at least one lower elevator car vertically below the weight fastened to the run, wherein in the case of an undesired approach of the two elevator cars the weight impinges on the second electromechanical switching mechanism;

c. providing a safety circuit of the at least one lower elevator car opened by the weight impinging on the second electromechanical switching mechanism; and d. providing a safety circuit of the at least one upper elevator car opened by a diminishing of the weight force.

2. The method according to claim 1 wherein the first electromechanical switching mechanism includes a lever element, a force store and a switch, wherein the run is fastened to the lever element to hold the lever element in the travel setting by the weight force of the weight fastened to the run and wherein the force store is connected with the lever element to transfer the lever element from the travel setting to an emergency setting when the weight force diminishes whereby the switch is actuated and the safety circuit is opened.

3. The method according to claim 1 wherein the second electromechanical switching mechanism includes a lever element, a force store and a switch, wherein the force store is connected with the lever element to maintain the lever element in a travel setting and wherein the second electromechanical switching mechanism is transferred from the travel setting to an emergency setting when the weight impinges on the lever element whereby the switch is actuated and the safety circuit is opened.

4. The method according to claim 3 wherein the second electromechanical switching mechanism includes a collecting element cooperating with the weight so that the weight impinges on the lever element of the second electromechanical switching mechanism even when slight oscillations occur during approach of the elevator cars.

5. An elevator installation operable according to the method of claim 1 including a drive and a holding brake for each of the elevator cars and wherein said drives of the two elevator cars are stopped and said holding brakes of the two elevator cars are triggered by opening of the safety circuits.

6. The elevator installation according to claim 5 wherein the first electromechanical switching mechanism and the second electromechanical switching mechanism form an electromechanical safety system for precluding collision to the two elevator cars.

7. Safety equipment for an elevator installation operable in accordance with the method of claim 1 wherein the safety equipment comprises the first and second electromechanical switching mechanisms.

8. An elevator installation having an upper elevator car and a lower elevator car, which cars are both vertically movable substantially independently in a common elevator shaft of the elevator installation, comprising:

a first electromechanical switching mechanism mounted in a lower region of the upper elevator car, wherein said first electromechanical switching mechanism includes a weight fastened to an elongate run, said weight applying a downwardly directed force to said run under the influence of gravity to maintain said electromechanical switching mechanism in a travel setting;

a second electromechanical switching mechanism mounted in an upper region of the lower elevator car vertically below said weight, wherein in the case of an undesired approach of the two elevator cars said weight impinges on said second electromechanical switching mechanism;

a safety circuit of the lower elevator car connected to said second electromechanical switching mechanism and being opened by said weight impinging on said second electromechanical switching mechanism; and a safety circuit of the upper elevator car connected to said first electromechanical switching mechanism and being opened by a diminishing of the weight force.

* * * * *